United States Patent [19]

Yoshida et al.

[11] 4,182,410

[45] Jan. 8, 1980

[54] PLATE TYPE CONDENSER

[75] Inventors: Keido Yoshida, Osaka; Kazuyuki Kobayashi, Nara; Hiroyuki Sumitomo, Takatsuki, all of Japan

[73] Assignee: Hisaka Works Ltd., Osaka, Japan

[21] Appl. No.: 770,565

[22] Filed: Feb. 22, 1977

[30] Foreign Application Priority Data

Feb. 28, 1976 [JP] Japan ..... 51-21554
Feb. 28, 1976 [JP] Japan ..... 51-21556

[51] Int. Cl.[2] ..... F28B 9/08
[52] U.S. Cl. ..... 165/110; 165/166; 165/170
[58] Field of Search ..... 165/110, 111, 170, 166, 165/167; 62/285, 288, 289, 290

[56] References Cited

U.S. PATENT DOCUMENTS

| | | | |
|---|---|---|---|
| 2,268,363 | 12/1941 | Wellington | 62/290 |
| 2,896,426 | 7/1959 | Ayling | 165/110 |
| 2,940,736 | 6/1960 | Odman | 165/166 |
| 3,840,070 | 10/1974 | Becker et al. | 165/110 |
| 3,902,551 | 9/1975 | Lim et al. | 62/290 |

FOREIGN PATENT DOCUMENTS

| | | | |
|---|---|---|---|
| 270533 | 5/1913 | Fed. Rep. of Germany | 165/110 |
| 1344608 | 1/1974 | United Kingdom | 165/110 |

*Primary Examiner*—Sheldon Jay Richter
*Attorney, Agent, or Firm*—Hall & Houghton

[57] ABSTRACT

A condenser having a heat transmitting surface wherein on the condensing and heat transmitting surface along which steam condensate flows down, steps are provided in a vertical row so that the condensate falls from the respective lower ends of the steps down to the lowermost end of the heat transmitting surface.

3 Claims, 13 Drawing Figures

PLATE TYPE CONDENSER

BACKGROUND OF THE INVENTION (a) Field of the Invention

The present invention relates to a condenser of the plate, tube or other type.

(b) Description of the Prior Art

Generally, of the plate type condensers now in use, many have been developed from the plate type condenser for liquid-to-liquid use only. In improving the heat transmitting performance of such condensers, what becomes a problem is the film coefficient which indicates the ease of heat transmission in a heat transmitting surface. The film coefficient is defined as the heat conductivity of the liquid film divided by the thickness of the liquid film, i.e., it is determined by the condition in which condensate adheres to the heat transmitting surface. Thus, if steam is fed to a heat transmitting surface constituting a steam passageway, a film of condensate is formed on the entire area of the heat transmitting surface. As condensation continues to proceed, the condensate film becomes gradually thicker and eventually flows down along the heat transmitting surface under its own weight and/or by the dynamic pressure of the steam. This liquid film merges with other liquid films at lower levels to become a thick downflow liquid film and the heat transmitting surface covered with this downflow liquid film is prevented from contact with steam, and since the thickness of the liquid film is increased, the film coefficient in that region of the surface is condiderably decreased, greatly lowering the heat transmitting performance. Therefore, in order to improve the heat transmitting performance of the entire heat transmitting surface, it is necessary to take measures to minimize the area of the downflow liquid film and prevent its thickness from being greatly increased.

As an example of such measure, the applicant has proposed along with the present invention a heat transmitting surface having longitudinal grooves arranged in several lines on the condensing and heat transmitting surface and inclined water collectors disposed at several places on said longitudinal grooves. According to this arrangement, the condensate on the heat transmitting surface is collected in the valleys of the longitudinal grooves by the action of surface tension and flows down along said valleys, and when its amount reaches a certain value, it flows into the water collectors. That is, the downflow liquid films are concentrated in the valleys of the longitudinal grooves, so that the film coefficient is maintained high as a whole. Further, where the effect of the longitudinal grooves extends, the presence of such water collectors is not required, and hence the number of such water collectors can be correspondingly reduced. However, such water collectors are absolutely necessary and require a corresponding space for arrangement.

At any rate, such conventional condenser requires water collectors on the heat transmitting surface for collecting the condensate on the way and allowing it to flow down for discharge. Such water collectors have to be arranged in a net pattern on the heat transmitting surface, thus occupying a considerable space in relation to the heat transmitting surface. From the standpoint of space, therefore, there has been a problem in connection with improving the overall coefficient of heat transfer.

SUMMARY OF THE INVENTION

The present invention has eliminated the disadvantages in the prior art described above, and basically, according to the invention, steps are arranged in a vertical row on a heat transmitting surface where condensate flows down in a filmy form, so as to allow the condensate to fall from the respective lower ends of said steps right down to the lowermost end of the heat transmitting surface.

FEATURES OF THE INVENTION

Since the condensate which forms on the heat transmitting surface effectively falls down to the lower end of the heat transmitting surface under its own weight and/or by the dynamic pressure of steam and discharged, it is possible to stepwise stop the growth of the downflow liquid condensate on the heat transmitting surface without providing a condensation discharging mechanism such as a water collector. Further, the entire area of the heat transmitting surface is effectively used for condensation and heat transmission, and hence the heat transmitting performance can be easily improved. Thus, a superior condenser can be obtained.

DESCRIPTION OF THE PREFERRED EMBODIMENTS

Figure 2:
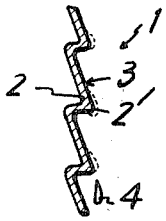
FIG. 2 is a longitudinal section of the heat transmitting surface shown in FIG. 1.
Figure 1:
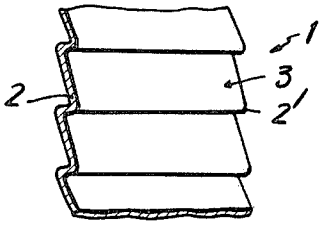
FIG. 1 is a perspective view of the principal portion of a concrete example of a condensing and heat transmitting surface according to an embodiment of the present invention.

The basic embodiment of the present invention is shown in FIGS. 1 and 2. In this embodiment, a smooth, heat transmitting surface 1 is provided with saw-tooth-like steps 2 in such a manner that the lower ends 2' of said steps 2 are located in a substantially vertical common plane. More particularly, the heat transmitting surface 1 is formed with a plurality of condensing and heat transmitting sections 3 defined by a vertical row of steps 2, the lowermost ends of said condensing and heat transmitting sections 3 being the lower ends 2' of said steps 2.

The process of condensation of steam on the heat transmitting surface 1 constructed in the manner described above is as follows.

When steam is passed onto the heat transmitting surface 1, thin films of condensate form on the condensing and heat transmitting sections and begin to flow down as they become gradually larger. Such film becomes gradually thicker toward its lower region. When such film approaches the lower end of the corresponding condensing and heat transmitting section 3, it is slowed down because of the presence of the step 2 and collects in that place. When the condensate which collects at the front end 2' of the step 2 increases in amount, its weight overcomes the surface tension, so that it falls by gravity in a drip 4 from a place on the front end 2'. This drip 4 touches the front end of the next lower step and merges with the condensate there. In this manner, it gradually grows large until it falls down to the lowermost end of the heat transmitting surface, and it is discharged from a discharging groove (not shown) to the outside of the apparatus. That is, the condensate falls from the lower ends 2' of the steps 2 like raindrops and they are finally collected at the lowermost end of the heat transmitting surface and discharged therefrom. Thus, it is seen that there is no need to provide a water collector or the like on the heat transmitting surface as in the conventional art. In addition, as for the length of the condensing and heat transmitting sections 3, it should be such that the downflow liquid film does not become too thick at the lower end.

Figure 4:
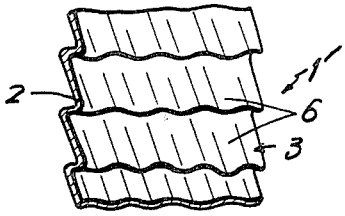
FIGS. 3 and 4 are perspective views of the principal portions showing applications of the heat transmitting surface shown in FIG. 1.
Figure 3:
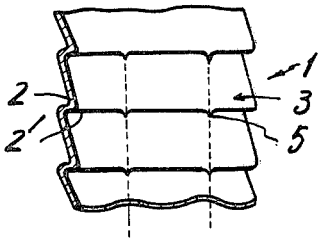

FIGS. 3 and 4 show examples in which the above-described heat transmitting surface 1 is improved. In FIG. 3, the numeral 6 designates projections downwardly directed at the required places on the front ends 2' of steps 2. The projections 5 are intended to collect the condensate which forms on the steps and to allow it to fall in a drip therefrom. Since such projections determine the positions from which drips fall, the designing is facilitated. Whereas the heat transmitting surface 1 described above is smooth, FIG. 4 shows a heat transmitting surface 1' having longitudinal grooves 6 in several lines. The combined use of the longitudinal grooves 6 and steps 2 adds the known merits of longitudinal grooves not found in a smooth surface, and since the positions from which drips fall are controlled by the lower ends of the longitudinal grooves 6, merits similar to those of said projections 5 can be obtained.

Figure 6:
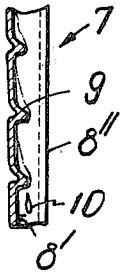
FIG. 6 is a longitudinal section of the heat transmitting surface shown in FIG. 5.
Figure 5:
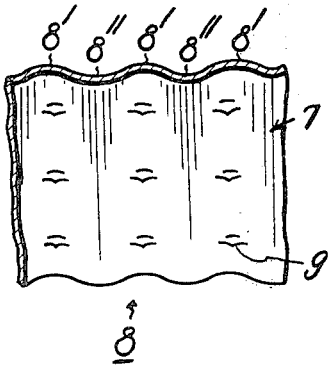
FIG. 5 is a perspective view of the principal portion showing an embodiment of the invention where a transmitting surface has longitudinal grooves.

In the two embodiments described above, the invention has been applied to heat transmitting surfaces 1, 1' on which a downflow liquid film forms over the entire area, but as for a heat transmitting surface on which a downflow liquid film forms locally, the invention takes, for example, a form shown in FIGS. 5 and 6. Thus, a heat transmitting surface indicated at 7 is of the type having longitudinal grooves 8 for collecting condensate and allowing it to flow down, wherein the condensate collects in the valleys 8' of the longitudinal grooves under the action of surface tension and then flows down. Such valley 8' is provided with projection-like steps 9 at predetermined intervals only in the regions where local downflow liquid films form, as shown. As a result of this arrangement, the condensate which collects in the valleys 8' of the longitudinal grooves 8 runs onto the steps and then falls in a drip 10.

Now, in the case of a steam passageway in a usual condenser, the steam flows downward during which it condenses on the heat transmitting surface. The rate of flow of this steam is higher toward the upper position of the heat transmitting surface and the dynamic pressure of the steam greatly influences the condition in which the condensate flows down.

Thus, a heat transmitting surface construction utilizing the dynamic pressure of steam for discharging the condensate will now be described with reference to FIGS. 7 through 10.

Figure 7:
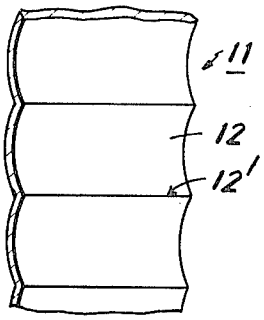
FIG. 7 is a perspective view of the principal portion of a heat transmitting surface having bights.
Figure 8:
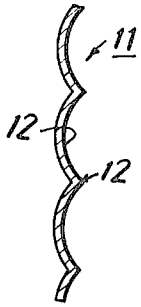
FIG. 8 is a longitudinal section of the heat transmitting surface shown in FIG. 7.

In FIGS. 7 and 8, the heat transmitting surface is designated at 11 and has bights 12 in a vertical row in several steps on the side facing the steam passageway. The bights 12 correspond to the above-described steps and may be formed by simply bending a flat plate into a wavy form and they are used as so-called condensing and heat transmitting sections. The bights 12 are arranged so that their lower ends 12' are in a common vertical plane. When steam is fed into a steam passageway defined by said heat transmitting surface 11, the steam flows down along the curved surface, with part of the steam condensed in the bights 12. Then the dynamic pressure of the steam blown against the bights 12 acts to blow off the condensate in the lower ends 12' of the bights 12 in the direction of an extension of each curve and eventually the condensate is scattered from the lower ends 12' of the bights 12 into the air inside the steam passageway and then falls. In this way, the condensate is scattered into the air and discharged before its thickness is greatly increased. Since the effect of discharging into the air of condensate by the dynamic pressure of steam is higher toward the upper region of the heat transmitting surface 11, it is preferable that the bights 12 be not of the same shape but have their respective optimum shapes corresponding to the respective stages.

Figure 9:
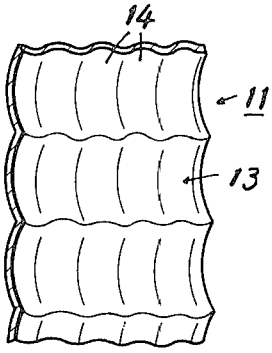
FIG. 9 is a perspective view of the principal portion showing an application of the heat transmitting surface shown in FIG. 7.

While the bights 12 have been shown as having a smooth surface, they may be improved into the form shown in FIG. 9, wherein bights 13 are provided with longitudinal grooves 14. In this case, the merits afforded by the longitudinal grooves 14 are added, enabling the condensate not only to be discharged more effectively but also to be discharged into the air concentratedly from constant positions, or from the lowermost ends of the surved surfaces. This is also convenient from the standpoint of design.

Figure 10:
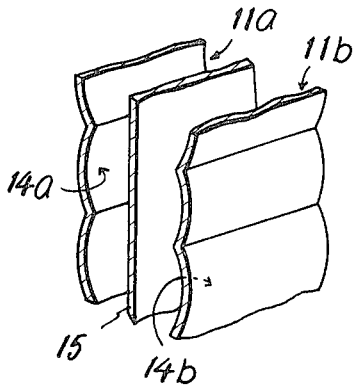
FIG. 10 is a fragmentary perspective view showing a pair of heat transmitting surface opposed to each other with a partition plate interposed therebetween.
Figure 11A:
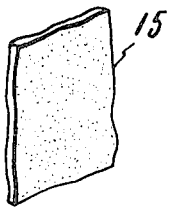
FIGS. 11*a* through 11*c* are perspective views of the principal portions, showing concrete examples of the partition plate shown in FIG. 10.
Figure 11B:
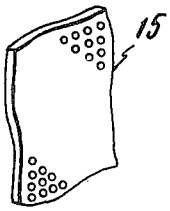
Figure 11C:
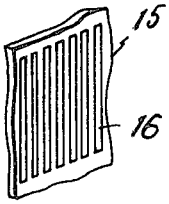

While the heat transmitting surface 11 described above has been shown as existing on only one side of the steam passageway, in practice two such opposed heat transmitting surfaces are provided. Therefore, when a pair of heat transmitting surfaces having bights are positioned close to each other in face-to-face relation, scattered condensate would adhere to the opposite sides, lowering the film coefficient on such surfaces. A solution to this problem is shown in FIG. 10, wherein a pair of heat transmitting surfaces **11*a*, 11*b* having bights 14*a*, 14*b*, respectively are opposed to each other with a partition 15 in the form of a plate interposed therebetween. Obviously, the function of the partition 15 is to prevent the condensate scattered from the bights 14*a*, 14*b* of the heat transmitting surfaces 11*a*, 11*b* from adhering to the opposite surfaces and to allow the condensate to flow down along the partition 15 for discharge. Further, according to the form of scattered condensate, the partition 15 may be porous as shown in FIG. 11*a* or perforated as shown in FIG. 11*b* or it may be provided with a number of longitudinal slits 16 as shown in FIG. 11*c***.

The foregoing description refers to the plate type, but it is clear that the present invention is also effectively applicable to the tube type or other type condensers.

We claim:

1. A rectilinear plate type condenser having a condensing and heat transmitting plate surface along which a steam condensate flows downwardly in the form of a film, said plate surface having a plurality of vertically spaced, horizontal top portions formed therein, each top portion being connected to the next succeeding downwardly spaced top portion by a downwardly and outwardly inclined surface portion thereby forming a step portion at the lower end of each downwardly and outwardly inclined surface portion along said plate surface, said downwardly and outwardly inclined surface portions being horizontally spaced whereby the condensate formed on each inclined surface portion of said plate surface will freely fall from the lower end of each downwardly and outwardly inclined surface portion downwardly to the next step portion at the lower end of the next succeeding downwardly and outwardly inclined surface portion until the collected condensate reaches the lowermost end of the heat transmitting surface.

2. A rectilinear plate type condenser in accordance with claim 1, wherein the surface of the outwardly inclined surface portion is smooth and uninterrupted.

3. A plate type condenser in accordance with claim 1, wherein each downwardly and outwardly inclined surface portion is provided with a plurality of laterally spaced, vertically disposed grooves, the free lower end of each groove terminating in a projection portion to facilitate the collection and dropping of condensate.

* * * * *